US006546911B1

(12) United States Patent
Fayyad et al.

(10) Patent No.: US 6,546,911 B1
(45) Date of Patent: Apr. 15, 2003

(54) DEFAULT METHODOLOGY FOR RECOVERING FROM LOSS OF HIGH RESOLUTION ENGINE POSITION SIGNAL

(75) Inventors: Salem Ahmad Fayyad, Grand Blanc, MI (US); Peter Hull Maehling, Brighton, MI (US); Charles O. James, Jr., Pinckney, MI (US); Kenneth M. Simpson, Burton, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/210,366

(22) Filed: Aug. 1, 2002

(51) Int. Cl.[7] ..... F02P 5/00
(52) U.S. Cl. ..... 123/406.13; 123/479; 701/114
(58) Field of Search ..... 123/406.13, 479, 123/406.11, 406.12, 406.18; 701/114

(56) References Cited

U.S. PATENT DOCUMENTS 4,265,210 A 5/1981 Hanisko
4,338,813 A 7/1982 Hunninghaus et al.
4,338,903 A 7/1982 Bolinger
4,979,117 A * 12/1990 Hattori et al. ..... 701/110
5,577,475 A 11/1996 DeBacker et al.
5,617,826 A 4/1997 Brandt
5,678,521 A 10/1997 Thompson et al.
5,710,703 A 1/1998 Kirn et al.
6,230,687 B1 5/2001 Marca
6,233,943 B1 5/2001 Beacom et al.

* cited by examiner

*Primary Examiner*—Bibhu Mohanty
(74) *Attorney, Agent, or Firm*—Vincent A. Cichosz

(57) ABSTRACT

A default engine control method for an internal combustion engine recovers from the loss of a high-resolution engine position signal by calculating a high resolution pulse period based on a recognized pattern of a low resolution engine position signal. Interrupts for signaling the execution of cycle-related control algorithms are scheduled in time based on the calculated pulse period, and pulse period errors due to changing engine speed are periodically corrected based on the timing of subsequent transitions in the low resolution position signal relative to the scheduled interrupts.

7 Claims, 3 Drawing Sheets

DEFAULT METHODOLOGY FOR RECOVERING FROM LOSS OF HIGH RESOLUTION ENGINE POSITION SIGNAL

TECHNICAL FIELD

This invention relates to the scheduling of timed events in an internal combustion engine based on a high resolution engine position signal, and more particularly to a method of scheduling such events when the high resolution position signal is lost or corrupted.

BACKGROUND OF THE INVENTION

When an internal combustion engine is controlled by a microprocessor-based control unit, the engine position is determined with crankshaft and/or camshaft position sensors, and events that occur in synchronism with engine position or stroke cycle are carried out by software routines executed in response to interrupt requests. The interrupt requests, in turn, are typically defined in terms of a position signal characteristic, such as a specified pulse number or a logic level transition. A common approach with four stroke engines is to utilize a high resolution position signal developed in response to crankshaft rotation (i.e., a crank signal) for interrupt scheduling, and to use a low-resolution position signal developed in response to camshaft rotation (i.e., a cam signal) to synchronize the crank signal with the engine stroke cycle. This approach is fairly cost effective, and provides some redundancy in the event of a sensor failure. However, the quality of control is significantly impaired when the high resolution sensor fails, and most default control strategies are only designed for what is commonly described as limp-home capability. Accordingly, what is needed is an improved default control method that is initiated in response to the loss of a high resolution engine position signal, and that more nearly achieves the control performance of a fully functional control system.

SUMMARY OF THE INVENTION

The present invention is directed to an improved default control method for recovering from the loss of a high-resolution position signal for an internal combustion engine, wherein a high resolution pulse period is calculated based on a recognized pattern of a low resolution engine position signal, interrupts for signaling the execution of cycle-related control algorithms are scheduled in time based on the calculated pulse period, and pulse period errors due to changing engine speed are periodically corrected based on the timing of subsequent transitions in the low resolution position signal relative to the scheduled interrupts. If an interrupt is scheduled to occur prior to an expected transition of the low resolution position signal, and the expected transition actually occurs first, the scheduled interrupt is serviced immediately, and the high resolution pulse period is re-calculated. If an interrupt is scheduled to occur after an expected transition of the low resolution position signal, and the interrupt actually occurs first, high resolution pulse period is re-calculated and used to re-schedule the interrupt.

BRIEF DESCRIPTION OF THE DRAWINGS

FIG. 3 depicts a main loop routine, and FIG. 4 depicts a default interrupt routine.

DESCRIPTION OF THE PREFERRED EMBODIMENT

Figure 1:
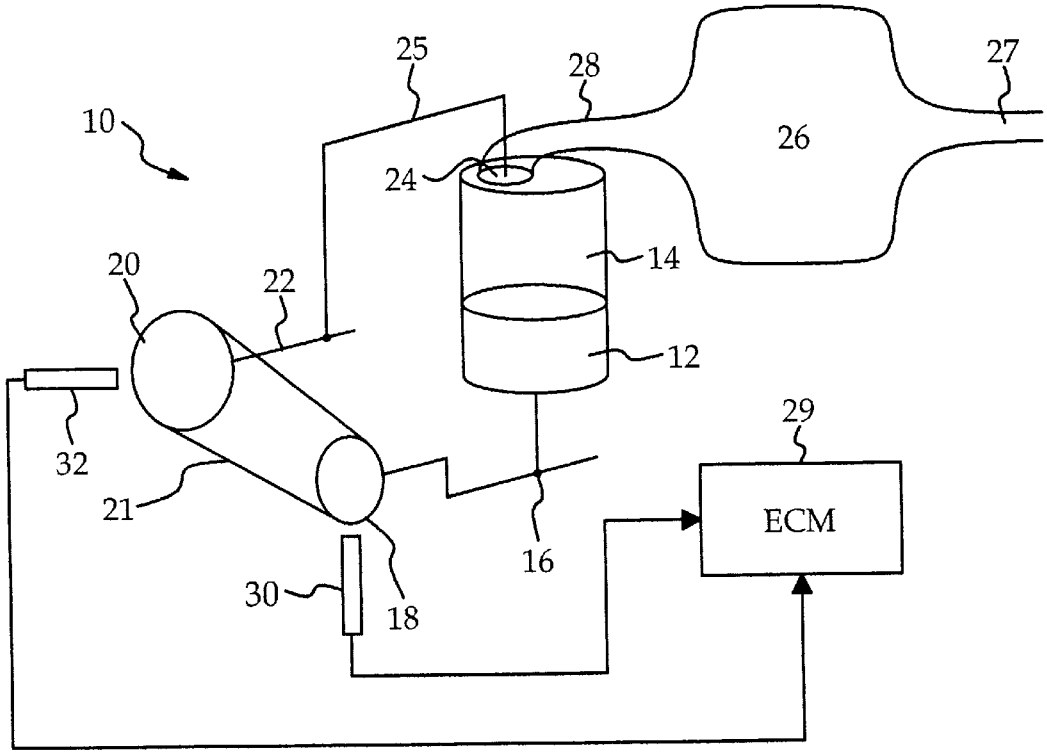
FIG. 1 is a schematic diagram of selected components of an engine control system according to this invention, including a crankshaft position sensor, a camshaft position sensor, and a microprocessor-based engine control module.

The present invention is disclosed in the context of an engine control system including a four-stroke internal combustion engine generally designated in FIG. 1 by the reference numeral 10. Referring to FIG. 1, the engine 10 includes a number of pistons 12 (only one of which is shown) which reciprocate in respective cylinders 14 and are connected to crankshaft 16. The crankshaft 16 is connected to the crank-wheel 18, which is mechanically coupled to a cam-wheel 20 by a belt or chain 21 so that the crank-wheel 18 and the cam-wheel 20 rotate synchronously. The cam-wheel 20 is connected to a camshaft 22, which opens and closes a cylinder intake valve 24 through a mechanical linkage 25 in coordination with the movement of piston 12. Intake air enters an intake manifold 26 through a throttle passage 27, and is delivered to each of the cylinders 14 via a respective intake runner 28 and intake valve 24. Obviously, engine 10 includes many other component parts that are also conventional and known in the state of the art to be part of an operational engine system.

The operation of engine 10 is regulated by a microprocessor-based engine control module (ECM) 29 in response to a number of inputs, including a crankshaft position signal developed by a sensor 30 responsive to the passage of teeth formed on the outer periphery of crank-wheel 18, and a camshaft position signal developed by a sensor 32 responsive to the passage of teeth formed on the outer periphery of cam-wheel 20. In response to these and other inputs, ECM 29 produces a number of outputs for controlling various engine control functions such as fuel injection and spark timing.

Figure 2:
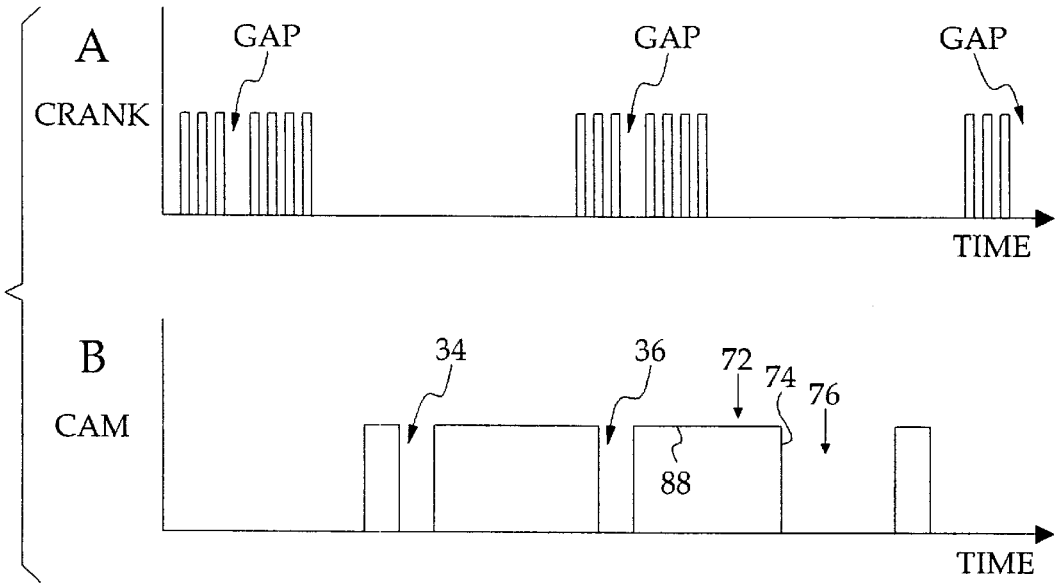
FIG. 2 is a timing diagram depicting crank and cam signals for the engine of FIG. 1 as a function of time.

The crank-wheel 18 (which rotates once per engine revolution) has a relatively large number of teeth, so that the sensor 30 produces a high resolution position signal such as depicted in Graph A of FIG. 2. A gap in the crank-wheel teeth produces a corresponding crank signal gap for each engine revolution, as also depicted in Graph A. The cam-wheel 20 (which rotates once for each two engine revolutions and therefore tracks the engine stroke cycle) has fewer teeth, and produces a low-resolution position signal having a characteristic pattern, as depicted in Graph B of FIG. 2. In normal operation, ECM 29 counts crank signal pulses beginning at each recognized gap, and uses a recognized logic level pattern of the cam signal to synchronize the pulse count with the engine stroke cycle. The synchronized crank signal is then used to schedule interrupts for signaling the execution of various control routines, such as fuel injection or spark timing routines, relative to predetermined points in the stroke cycle. However, if the crank signal is lost due to an electrical or mechanical failure, ECM 29 must use another method of scheduling stroke-cycle related interrupts, and the present invention is directed to such a method.

According to the method of the present invention, the ECM 29 responds to an indicated failure of the crank signal by calculating a high resolution pulse period based on a recognized pattern of the cam signal or some other low resolution engine position-related signal. Interrupts for signaling the execution of cycle-related control algorithms (such as fuel and spark control algorithms) are scheduled based on the calculated pulse period, and pulse period errors are periodically corrected based on the timing of subsequent transitions of the cam signal relative to the scheduled interrupts. If an interrupt is scheduled to occur prior to an expected transition of the cam signal, and the expected transition actually occurs first, the scheduled interrupt is serviced immediately, and the high resolution pulse period is re-calculated. If an interrupt is scheduled to occur after an expected transition of the cam signal, and the interrupt actually occurs first, high resolution pulse period is re-calculated and used to re-schedule the interrupt.

Figure 3:
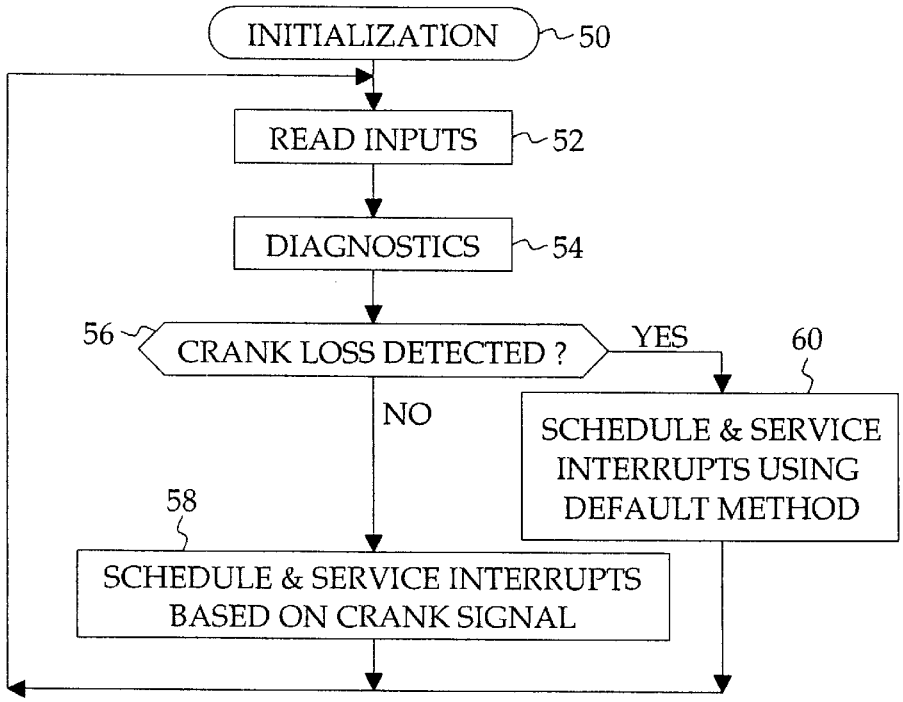
FIGS. 3 and 4 are flow diagrams representative of software routines executed by the engine control module of FIG. 1 in carrying out the control of this invention.
Figure 4:
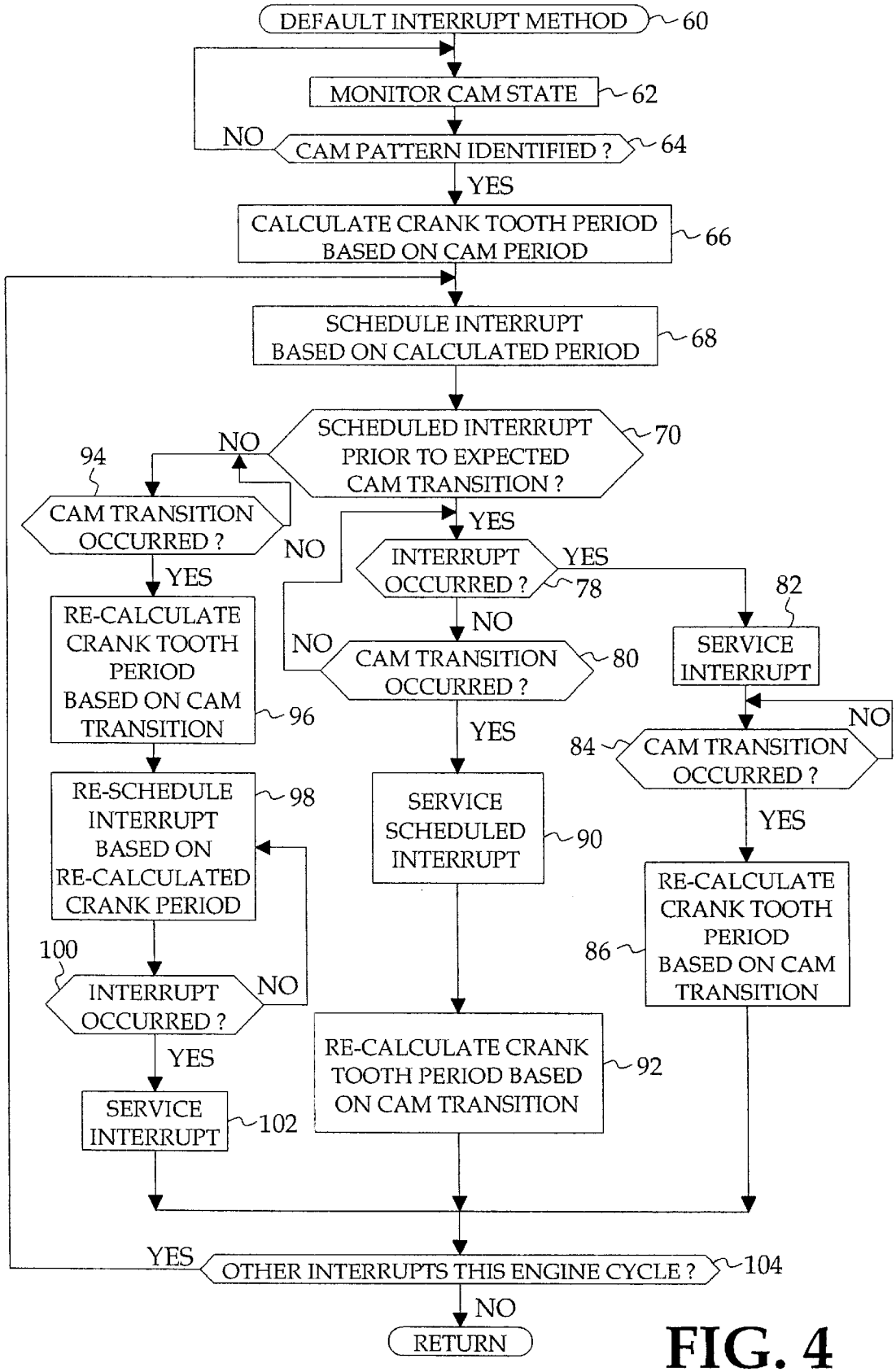

The above-described method is illustrated in further detail by the flow diagrams of FIGS. 3 and 4, where FIG. 3 is a main flow diagram and FIG. 4 details a portion of the main flow diagram pertaining to default interrupt logic. As will be recognized by those skilled in the art, flow diagrams describe the functionality of software routines executed by ECM 29 in carrying out the method of this invention.

Referring to the main flow diagram of FIG. 3, the reference numeral 50 designates a series of initialization instructions executed at the beginning of each period of engine operation for initializing various parameters and variables to predetermined states. Thereafter, the blocks 52–60 are periodically executed as shown to schedule and service interrupt requests for executing engine cycle-related control algorithms. After the various system inputs, including the crank and cam signals, are read at block 52, the block 54 executes a number of diagnostic routines to detect the occurrence of system failures. For example, a crank signal failure can be detected if it is absent while other signals indicative of engine rotation (such as the cam signal) are present. Ordinarily, of course, the crank signal is fully operative, and the blocks 56 and 58 are executed to schedule and service the cycle-related control algorithms based on the crank and cam signals as generally described above. However, if a failure of the crank signal is diagnosed at block 54, the block 56 is answered in the affirmative, and the block 60 is executed to carry out the default interrupt methodology of this invention.

Referring to FIG. 4, the default interrupt methodology of the present invention initially involves monitoring the cam signal and identifying a predetermined logic transition pattern, as indicated at blocks 62 and 64. For example, referring to Graph B of FIG. 2, a predetermined point in the engine stroke cycle can be identified in the cam signal by the occurrence of two consecutive relatively short duration low logic level periods, designated by the reference numerals 34 and 36. In the illustrated embodiment, the rising edge of the cam signal following the logic period 36 always coincides with a crank signal gap, providing a convenient starting point for scheduling cycle-related interrupts based on a calculated crank pulse period. Once the cam signal pattern is recognized, the block 66 is executed to calculate a crank tooth period based on the recognized cam period. For example, if it is known that the logic period 36 corresponds to N pulses of the crank signal, the crank pulse period may be calculated as T36/N, where T36 is the measured duration of the logic period 36. Once the crank tooth period has been calculated, the block 68 schedules the next-to-occur interrupt in terms of a predetermined number of crank tooth periods.

After an interrupt has been scheduled at block 68, the block 70 determines whether the scheduled interrupt will occur prior to an expected transition of the cam signal. For example, referring to FIG. 2, if the interrupt scheduled at block 68 is expected to occur where indicated by the arrow 72, prior to the high-to-low transition 74 of the cam signal, the block 70 will be answered in the affirmative. On the other hand, if the interrupt scheduled at block 68 is expected to occur where indicated by the arrow 76, after the high-to-low transition 74, the block 70 will be answered in the negative.

In cases where an interrupt is scheduled to occur prior to an expected transition of the cam signal, the blocks 78 and 80 determine which event actually occurs first. If the interrupt occurred first as expected, blocks 82, 84 and 86 are executed to service the interrupt, and to re-calculate the crank tooth period once the cam transition actually occurs. For example, and referring to FIG. 2, if it is known that the logic period 88 corresponds to M pulses of the crank signal, the crank pulse period may be calculated as T88/M, where T88 is the measured duration of the logic period 88. On the other hand, if the cam signal transition 74 occurs first, ECM 29 concludes that the crank tooth period has been overestimated; in this case, the scheduled interrupt is serviced immediately by block 90, and then block 92 re-calculates the crank tooth period based the cam signal period.

In cases where an interrupt is scheduled to occur after an expected transition of the cam signal, the block 94 is repeatedly executed to determine when the cam transition actually occurs. At such point, the blocks 96 and 98 are executed to re-calculate the crank tooth period based on the cam signal period, and to re-schedule the interrupt based on the re-calculated tooth period. The block 100 then identifies when the interrupt occurs, and the block 102 services the interrupt. This effectively prevents a scheduled interrupt from occurring too soon in the engine cycle due to underestimation of the crank tooth period.

As indicated by block 104, the above-described control methodology defined by the blocks 68–102 can be repeated in the course of a given engine cycle until all necessary interrupts have been scheduled and serviced. Thereafter, the block 104 is answered in the negative, and ECM 29 returns to the main flow diagram of FIG. 3.

In summary, the method of the present invention provides an improved methodology for recovering from the loss of a high-resolution position signal by calculating a high resolution pulse period based on a recognized pattern of a low resolution engine position signal, and monitoring the relative timing of the scheduled interrupt requests and the subsequent transitions in the low resolution position signal in order to minimize error in the timing of the scheduled interrupts due to changes in engine speed. In a mechanization of the present invention, the default control methodology was sufficiently accurate to enable continued engine operation in the presence of crank signal loss without significant degradation of engine performance and emission control; in the event of crank signal loss, a "check engine" or similar warning lamp is lit to advise the operator of the failure so that corrective action may be taken.

While described in reference to the illustrated embodiment, it is expected that various modifications will occur to those skilled in the art. For example, the low resolution signal may be a signal other than a cam signal, or multiple low resolution signals may be utilized to calculate the high resolution pulse period. Thus, it should be understood that methods incorporating these and other modifications may fall within the scope of this invention, which is defined by the appended claims.

What is claimed is:

1. A method of scheduling cycle-related control events of an internal combustion engine, comprising the steps of:

normally scheduling said control events based on level transitions of a high resolution pulsetrain developed in response to movement of a rotary shaft of the engine; and in response to a detected loss of said high resolution pulsetrain:

monitoring a low resolution signal having an engine cycle-related pattern;

identifying said engine cycle-related pattern;

calculating a pulse period of said high resolution pulsetrain based on a pulse interval of the identified pattern; and scheduling said control events in time based on the calculated pulse period.

2. The method of claim 1, including the steps of:

determining an occurrence of an expected transition of said low resolution signal relative to at least one of said control events; and rescheduling such control event based on such determination.

3. The method of claim 2, including the step of:

re-scheduling such control event for immediate execution if the expected transition of said low resolution signal is supposed to occur after such control event, but is determined to occur before such control event.

4. The method of claim 2, including the steps of:

re-calculating the pulse period of said high resolution pulsetrain based on a pulse interval of the low resolution signal that is defined by said expected transition; and re-scheduling such control event in time based on the re-calculated pulse period.

5. The method of claim 1, including the steps of identifying another pulse interval of said low resolution pulsetrain; and re-calculating the pulse period of said high resolution pulsetrain based on such other pulse interval.

6. The method of claim 1, wherein said high resolution pulsetrain is developed in response to movement of an engine crankshaft, and said low resolution signal is developed in response to movement of an engine camshaft.

7. The method of claim 1, including the step of:

returning to the normal scheduling of said control events based on level transitions of said high resolution pulsetrain when said high resolution pulsetrain is recovered following its detected loss.

* * * * *